United States Patent [19]

Raiha

[11] Patent Number: 4,549,463

[45] Date of Patent: Oct. 29, 1985

[54] DECAPPING TOOL

[76] Inventor: Antti P. Raiha, 8425 Sunnyside Rd., Sandpoint, Id. 83864

[21] Appl. No.: 568,345

[22] Filed: Jan. 5, 1984

[51] Int. Cl.[4] ..... F42B 33/10

[52] U.S. Cl. ..... 86/36; 86/37

[58] Field of Search ..... 86/32, 33, 36, 37, 38, 86/24, 23, 25, 44

[56] References Cited

U.S. PATENT DOCUMENTS

| | | | |
|---|---|---|---|
| 3,134,293 | 5/1964 | Lee | 86/37 |
| 3,283,643 | 11/1966 | Mittelsteadt | 86/36 |
| 4,189,980 | 2/1980 | Schaenzer | 86/37 |
| 4,329,906 | 5/1982 | Heers | 86/36 |
| 4,332,185 | 6/1982 | Hargrove | 86/36 |
| 4,385,546 | 5/1983 | Lee | 86/36 |
| 4,409,878 | 10/1983 | McClenning | 86/37 |

*Primary Examiner*—Stephen J. Lechert, Jr.
*Assistant Examiner*—Howard J. Locker
*Attorney, Agent, or Firm*—Fred Flam

[57] ABSTRACT

A decapping tool includes a pair of holders, one providing a conical seat for the cartridge head, and the second providing a conical center for the cartridge mouth. The holders are spring urged towards each other whereby the cartridge is held and centered irrespective (within limits) of its length or caliber. A punch rod extends through the center, into the cartridge to the region of the primer cap at the flash hole. An anvil attached to the rear end of the punch rod is engaged by a crank.

5 Claims, 5 Drawing Figures

DECAPPING TOOL

FIELD OF INVENTION

This invention relates to the reloading arts, and particularly to a small machine for decapping fired shells.

BACKGROUND OF THE INVENTION

In order to reload a center fire cartridge shell, it is first necessary to remove the spent primer, an operation generally called "decapping". Decapping is customarily done at as a part of the sizing or resizing operation. Thus, a punching tool is generally engrafted upon the end of a sizing die. Since the reach to the flash port may be long, there is a danger that concentricity will be lost and that the flash hole may be mutilated or the tool itself will become broken or bent. Separating the operations of decapping and sizing is arguably logical, but in practice quite inconvenient because each cartridge must have its own holder.

The primary object of the present invention is to provide a new and improved decapping tool that is universally usable with center fire cartridges of all sizes.

SUMMARY OF INVENTION

In order to accomplish the foregoing objective, I provide a pair of cartridge holders cooperable respectively with the head and mouth ends of the cartridge. These holders are mounted respectively by a tail bracket and a head bracket of the decapping tool body. One of the holders provides a concave conical seat and the other of the holders provides a convex conical locator or center. One of the holders is movable towards and away from the other holder and is biased, as by a spring, towards the other holder. The cartridge to be decapped is held against the seat and centered by the locator. A decapping punch or rod is mounted for sliding movement inside the locator and is engaged by a crank for application of a decapping force to the spent primer. A simple retracting mechanism releases the cartridge.

BRIEF DESCRIPTION OF THE DRAWINGS

A detailed description of the invention will be made with reference to the accompanying drawings wherein like numerals designate corresponding parts of the several figures. These drawings are to scale.

DETAILED DESCRIPTION OF THE PREFERRED EMBODIMENT

The following detailed description is of the best presently contemplated mode of carrying out the invention. This description is not to be taken in a limiting sense, but is made merely for purposes of illustrating the general principles of the invention, the scope of the invention being best defined by the appended claims.

Figure 1:
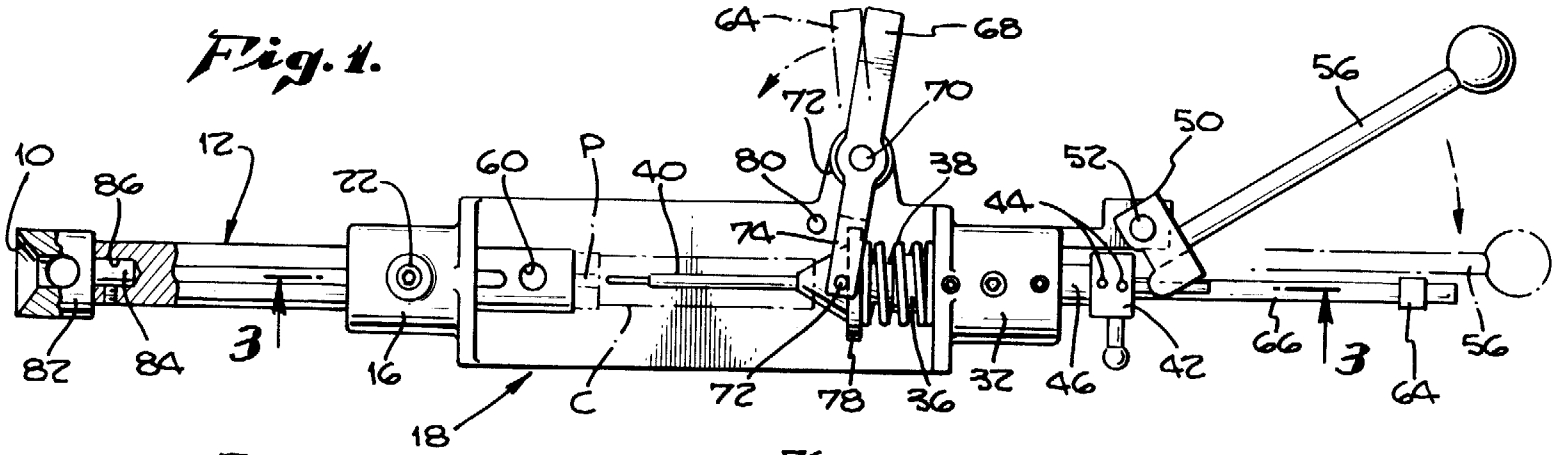
FIGS. 1 and 2 are top and side plan views of a decapping tool incorporating the present invention, part of the reversible holder being broken away and shown in section in FIG. 1.
Figure 2:
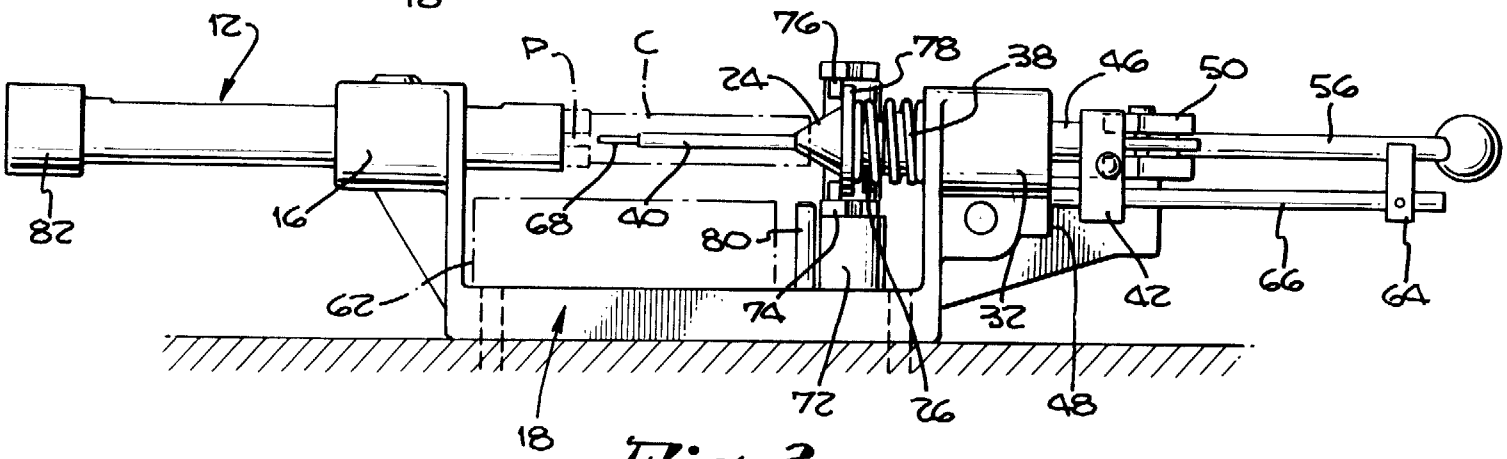

In FIGS. 1 and 2, a cartridge C to be reloaded, shown in phantom lines, is releasably held between a pair of companion holders. The head end of the cartridge is urged (by means hereinafter to be described) to engage a substantially conical concave seat 10 that forms the operative part of one of the holders 12. The holder 12 is an elongated generally cylindrical bar or rod. The holder 12 slidably fits a bore 14 of a tail bracket 16 of a miniature lathe or tool body 18 and is held in place by a set screw 22.

The cartridge is urged against the seat 10 by the aid of a locator or center 24 forming the operative part of the companion holder 26. The locator or center 24 is convex and substantially conical. The holder 26 has a cylindrical mounting stem 28 projecting rearwardly. The stem 28 slidably fits the inboard end of a through bore 30 of a head bracket 32 of the tool body 18 whereby the holder 26 is mounted for limited axial movement toward and away from the companion holder 12. The bore 30 in the present instance is formed by a separate insert 34 of suitable bearing material fitted to a larger bore 36 of the head bracket 32.

A heavy compression spring 38 interposed between the head bracket 32 and the rear surface of the center 26 to urge the holder 26 toward the companion holder 12. The center 26 enters the mouth of the cartridge C and engages the mouth edges from the inside. The cartridge is urged against the seat 10. Since the holder 26 is free to move axially, it automatically accommodates to the length of the cartridge, which may vary. The conical elements 10 and 26 together operate by a cam like action to move the cartridge into a coaxial position.

The primer is removed from its pocket by the aid of a punch rod 40. The punch rod 40 is guided for axial movement inboard of the head bracket 32 by an elongated aperture 42 in the holder 26. At the outboard end, the punch rod 40 is guided by an anvil 42. The anvil 42 is attached to the rod by set screws 44. The rod guiding function of the anvil 42 is performed by a cylindrical neck 46 slidably fitted to the outboard end of the head bracket bore 30.

The punch rod 40 extends through the holder 26 and into the cartridge C. In the position shown in FIGS. 1 and 2, the primer P is about to be dislodged. The forward end of the rod 40 is spaced slightly from the bottom of the primer cup at the flash hole and the anvil 42 is spaced from the outer end surface 48 of the head bracket 32. When the anvil 42 and the punch rod 40 are advanced until the punch rod just contacts the primer cup, the spacing between the anvil and the tool bracket 32 slightly exceeds the axial dimension of the primer to be removed. This is achieved by proper placement of the set screws 44.

Figure 4:
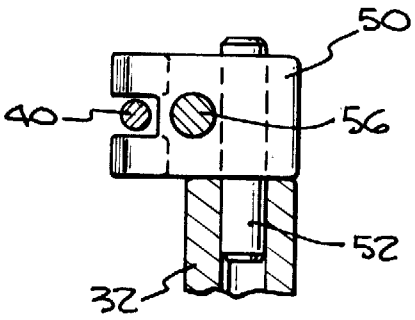
FIG. 4 is an enlarged transverse sectional view taken along a plane corresponding to line 4—4 of FIG. 3.
Figure 5:
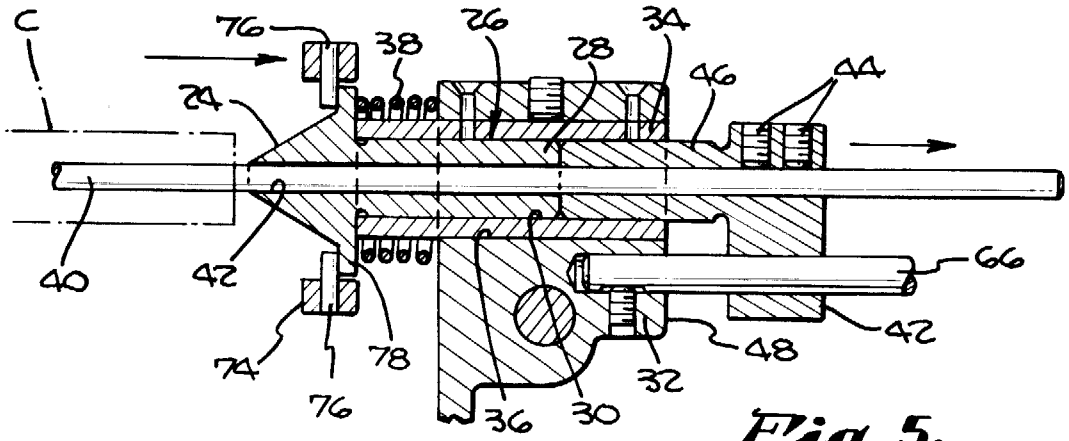
FIG. 5 is a sectional view similar to FIG. 3, but on a further enlarged scale, showing the retractable part of the holder in its retracted position.

In order to exert pressure on the anvil 42, a crank 50 is provided. The crank is pivotally mounted on a vertical pin 52 in turn mounted on a lug 54 (FIG. 1) extending laterally of the head bracket 32. A handle 56 attached to the crank 50 is operative to move the crank in a clockwise direction as shown in FIG. 1 thereby to engage and move the anvil 42. The crank 50 is slotted (FIG. 4) to allow it to straddle the projecting end of the punch rod 40.

Figure 3:
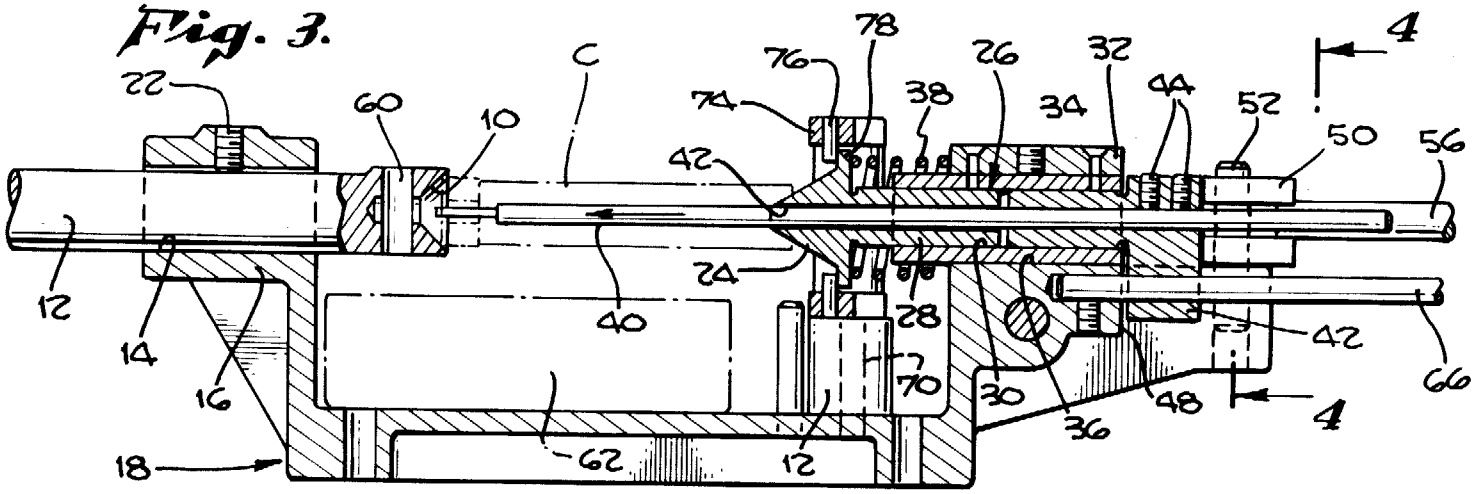
FIG. 3 is an enlarged longitudinal sectional view taken along a plane corresponding to line 3—3 or FIG. 1.

In the position shown in FIG. 3, the punch rod 40 has advanced to dislodge the primer. A transverse bore 60 in the holder 12 just behind the seat 10 allows the dislodged primer P to drop into a pan 62 resting on the bed of the tool body 18.

Once the primer P is dislodged, the cartridge C is released by retracting the holder 26. But before the cartridge C can be removed, the punch rod 40 must be withdrawn from the cartridge. This is easily done by using the projecting end of the punch rod 40 or the anvil 42 as a handle. A stop 64 (FIGS. 1 and 2) mounted at the end of a rod 66 is in the path of retracting movement of the anvil 42. When the anvil 42 engages the stop 64, the forward end of the punch rod has withdrawn inside the holder 26. The center 24 is now withdrawn to release the decapped cartridge C.

For this purpose a lever 68 (FIG. 1) is provided that is pivotally mounted on a vertical pin 70 in turn mounted on a lateral lug 72 of the tool body 18. The operative end of the lever is formed as a yoke 74 (FIGS. 2, 3 and 4) having inwardly projecting pins 76 positioned to engage a peripheral flange 78 at the base of the center or locator 24. The lever is moved from a its passive position shown in full lines in FIG. 1 to the phantom line position as indicated by the arrow. This causes the locator 24 to move from the position of FIG. 3 to the retracted position shown in FIG. 4. The handle end of the lever is as long as need be to operate the spring 34.

After the decapped cartridge C is removed, another cartridge may be inserted and the operation repeated. If, however, the handle 68 is released before another cartridge is inserted, a stop rod 80 (FIGS. 1, 2 and 3) by engagement with the handle 68 prevents the holder 26 from being ejected from the head bracket 32.

The seat 10 accommodates the heads of cartridges of various calibers within a range. In order to accommodate cartridges of larger calibers, an adapter 82 is provided that fits the opposite end of the holder 12. The adapter 82 has a mounting stud 84 that fits an end recess 86 of the rod or bar 12. Larger caliber cartridges of course have larger primer cups to accommodate larger primers. Accordingly, a punch rod with a larger diameter head is required. For this purpose, a different punch rod may be provided. However, for convenience, a punch rod with a larger end is provided by reversing the rod and reattaching the anvil to the opposite end. In the present example, the end of the rod itself will contact the primer cup, whereas for the smaller diameter cartridges, a small pin 88 is used for the decapping function. The punch rod 40 and anvil 42 are easily removed and replaced by angularly moving the crank 50 in a counterclockwise position as shown in FIG. 1 and by temporarily detaching the stop 64. The path of movement of the anvil 42 is then cleared.

The sizes and shapes of cartridges vary widely. The decapping tool shown is capable of substantially universal use for all cartridges.

Intending to claim novel, useful and unobvious features shown or described, I claim:

1. In a decapping tool for a center fire cartridge having a base, a neck and a flash port:

(a) a tool body;

(b) a pair of cartridge holders;

(c) one of said cartridge holders providing a substantially conical concave seat adapted to engage the peripheral edges of the cartridge base, and the other of said cartridge holders providing a substantially convex conical center adapted to enter the cartridge neck to engage the edges thereof;

(d) means mounting said holders in coaxial relationship on said tool body and providing a degree of freedom of one of said holders for movement towards and away from the other of said holders;

(e) means biasing said holders for movement towards each other so that a cartridge inserted between said holders is held and centered thereby, the actual annular areas of said concave seat and convex center engaged by the edges of said cartridge base and the edges of said cartridge neck being determined by the sizes of said edges, whereby said holders accommodate and center said cartridge despite variations in length and caliber;

(f) a decapping punch rod guided directly or indirectly by said tool body independently of said cartridge for axial movement through said center to the region of the flash port of the cartridge; and (g) a crank mechanism for moving said punch rod through said flash port for decapping said cartridge.

2. The decapping tool as set forth in claim 1 together with an anvil selectively secured to one or the other end of said punch rod and engaged by said crank mechanism, opposite ends of said punch rod having tips of different diameters for cooperation with primers of different sizes.

3. The decapping tool as set forth in claim 1 or claim 2 in which said biasing means comprises a spring interposed directly or indirectly between said one of said holders and said tool body; and lever means for retracting said one of said holders against the force of said spring for releasing the cartridge held by said holders.

4. The decapping tool as set forth in claim 1 or claim 2 or claim 3 in which the holder providing said concave seat is reversible in said tool body, and having seats of different sizes at opposite ends for accommodating heads of cartridges of different calibers.

5. In a decapping tool for center fire cartridges:

(a) a tool body having a head bracket and a tail bracket;

(b) a pair of cartridge holders;

(c) means coaxially mounting said cartridge holders on said tool brackets respectively and providing a degree of freedom for at least one of said holders for axial movement towards and away from the other of said holders;

(d) one of said cartridge holders providing a substantially conical concave seat, and the other of said cartridge holders providing a substantially conical center;

(e) spring means biasing said holders for movement towards each other so that a cartridge inserted between said holders is held and centered thereby irrespective of length and caliber variations;

(f) a decapping punch rod guided directly or indirectly by said tool body for axial movement through said center to the region of the flash port of the cartridge;

(g) an anvil detachably secured to one end of said punch rod;

(h) a crank mechanism for engaging said anvil to move said punch rod through said flash port for decapping said cartridge.

(i) and a lever for retracting the spring to allow placement and removal of the cartridge.

* * * * *